United States Patent [19]

Sedig et al.

[11] 4,445,744

[45] May 1, 1984

[54] HIGH PRESSURE ELECTRICAL CONNECTOR

[75] Inventors: Albert R. Sedig, Buckeye; Francis H. Ingham, Scottsdale, both of Ariz.

[73] Assignee: ITT Corporation, New York, N.Y.

[21] Appl. No.: 399,707

[22] Filed: Jul. 19, 1982

[51] Int. Cl.[3] ..... H01R 4/70

[52] U.S. Cl. ..... 339/94 M

[58] Field of Search ..... 339/94 R, 94 M, 94 A, 339/126 R, 126 RS; 174/151, 152 G, 152 GM, 153 R

[56] References Cited

U.S. PATENT DOCUMENTS

| | | | |
|---|---|---|---|
| 3,331,913 | 7/1967 | Johnson | 174/152 GM |
| 3,465,284 | 9/1969 | McManus | 339/196 |
| 3,721,948 | 3/1973 | Brandt et al. | 339/176 R |
| 3,803,531 | 4/1974 | Sorensen | 339/60 M |
| 3,998,515 | 12/1976 | Panek | 339/94 A X |
| 4,138,183 | 2/1979 | Soos | 339/94 M |
| 4,174,145 | 11/1979 | Oeschger et al. | 339/94 A |
| 4,176,901 | 12/1979 | Ishimaru | 339/136 M |

OTHER PUBLICATIONS

Paper entitled "Pressure-Compensated Electro-Connective Systems for Outboard Usage on Deep Submersibles" by Donald G. O'Brien, IEEE 1971 Eng. in the Ocean Environment Conf.

*Primary Examiner*—Eugene F. Desmond

*Attorney, Agent, or Firm*—T. E. Kristofferson; T. L. Peterson

[57] ABSTRACT

A high pressure withstanding electrical connector or penetrator is disclosed in which a header containing glass sealed conductors is removably mounted on the high pressure side of the connector shell. An integral web extends across the shell which provides mechanical support for the header.

8 Claims, 2 Drawing Figures

HIGH PRESSURE ELECTRICAL CONNECTOR

BACKGROUND OF THE INVENTION

The present invention relates generally to an electrical connector or penetrator and, more particularly, to such a connector or penetrator which is capable of withstanding very high pressures.

The term "electrical connector" utilized throughout this specification is intended to include electrical penetrators and other forms of electrical interconnecting devices. An electrical connector of the type to which the present invention relates generally comprises a metal shell which is installed into a pressure withstanding bulkhead, wall or underwater hull structure. Electrical conductors are mounted in the shell by glass, glass-ceramic, or ceramic insulators which are sealed in the shell. There may be individual insulators for each conductor in the form of individual glass ring seals or beads, such as disclosed in U.S. Pat. Nos. 3,735,024; 3,750,088 and 3,780,204. Alternatively, a single insulator may be utilized in the shell with multiple holes receiving the conductors, such as disclosed in U.S. Pat. Nos. 3,998,515 and 4,088,381. The conductors are normal double-ended pin contacts. Plug connectors having socket contacts in them can be mated on one or both sides of the electrical connector containing the sealed pin contacts.

Normally the conductors are sealed in the electrical connector shell by a compression type seal. The coefficient of thermal expansion of the metal shell is higher than the glass, resulting in high compressive stresses in the glass during the cooling cycle during the glass sealing operation. These high compressive stresses result in excellent sealing characteristics. However, the differences in thermal coefficient of expansion of the glass and metal cause longitudinal stresses in the glass seals. These stresses increase as the length-to-diameter ratio of the glass bead increases, resulting in shearing and cracking of the glass. Preferably the foregoing ratio should not exceed four, otherwise fracturing of the glass seal may occur. For example, in a moderately dense contact arrangement layout (208 contacts in a connector layout diameter of 4.5 inches), if the glass bead diameter is about 0.200 inches, the length of the bead should not exceed 0.75 inches. Such connector is capable of withstanding pressures up to 2,000 psi. This pressure capability could be increased by using a connector shell which has a thicker metal web, using individual beads which are relatively short. However, in such an arrangement electrical problems are encountered because of plating salts and/or other contaminants becoming entrapped in the contact passages in the metal web during the manufacturing process of the connector.

It is the object of the present invention to provide an electrical connector which is capable of withstanding considerably higher pressures than the prior art connectors, yet does not encounter the electrical problem which is mentioned above resulting from contaminants being entrapped in contact passages in the connector header.

SUMMARY OF THE INVENTION

According to the principal aspect of the present invention, there is provided an electrical connector or penetrator in which a separable glass sealed header which is relatively thin with low length-to-diameter ratio beads is installed into a connector shell having an integral fixed metal web with clearance holes in it through which the conductors in the header extend. The metal web provides support for the header to withstand high pressures. Thus, by the present invention excellent glass seals may be made in the separable header and combined with the structural strength of the integral web of the shell to provide a glass sealed electrical connector which is capable of withstanding very high pressures.

DESCRIPTION OF THE PREFERRED EMBODIMENT

Figure 1:
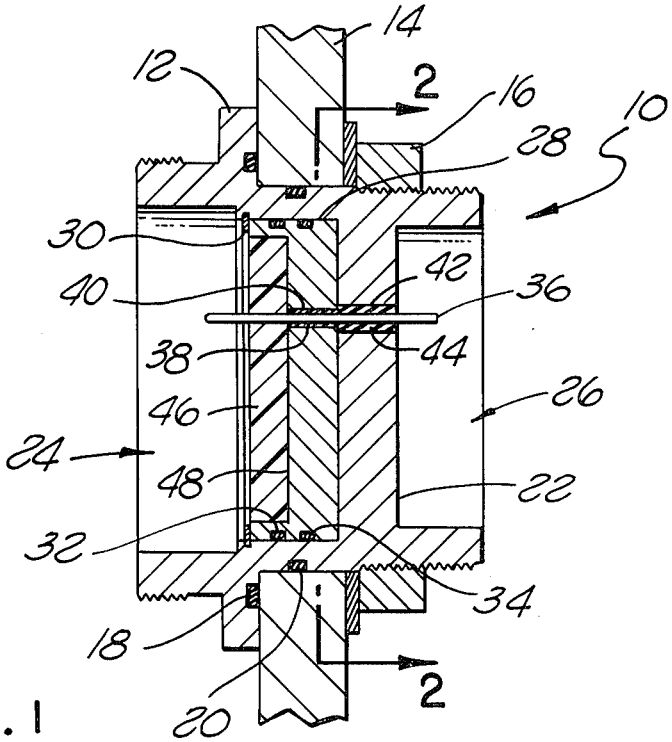
FIG. 1 is a longitudinal sectional view through the connector of the present invention shown mounted in a bulkhead.
Figure 2:
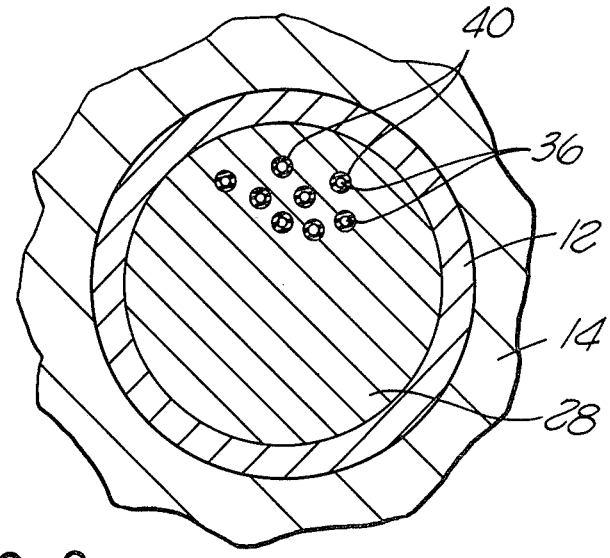
FIG. 2 is a transverse sectional view taken along line 2—2 of FIG. 1.

Referring now to the drawing in detail, the connector of the present invention, generally designated 10, comprises a shell 12 which is mounted in a bulkhead 14 by a retaining nut 16. O-rings 18 and 20 provide a seal between the connector shell and the bulkhead.

The shell is formed with an integral support web 22 which extends transversely across the interior of the shell dividing the shell into a high pressure side 24 and a low pressure side 26.

A separable header 28 is removably mounted in the shell on the high pressure side 24 immediately adjacent to the support web 22. A retaining ring 30 retains the header in the shell. A pair of O-rings 32 and 34 are mounted in annular grooves in the outer periphery of the header to provide a seal between the header and the interior of the shell.

A plurality of conductors 36, preferably in the form of double-ended pin contacts, are mounted in passages 38 extending through the header. Each conductor is sealed in its respective passage by a glass ring or bead 40 providing a glass-to-metal seal between the conductor and the header. The term glass seal used herein to describe the seals for the conductors 36 is intended to include not only a pure glass seal, but also glass/ceramic or ceramic seals.

Clearance holes 42 are formed in the support web 22 aligned with the passages 38 in the header. One end of each conductor 36 extends into the high pressure side 24 of the shell of the connector while the opposite end extends through the clearance holes 42 into the low pressure side of the shell. The conductors 36 are preferably insulated from the support web 22 by use of a suitable potting compound 44 or other similar insulator material in the clearance holes 42 to prevent contact with the metal shell if the conductors are bent. Preferably a potting compound 46 fills a recess 48 in the outer face of the header 28 to prevent contamination of the glass seals 40.

As seen in FIG. 1, the inner face 50 of the header containing the glass sealed conductors lies flush against the surface of the integral web 22 of the shell so that the web provides ample support for the header across the entire inner face of the header.

Since the support web 22 does not contain the glass seals, there is no specific limit on the thickness of the web so that the web may be made as thick as necessary to withstand extremely high pressures, estimated to be up to 20,000 psi or more depending upon the exact dimensional configuration of the connector shell and the web.

On the other hand, the header may be relatively thin so that the desired ratio of the length of the glass beads 40 to their diameter may be maintained, so that glass fracturing can be avoided. A thick header is not required which leaves voids which entrap contaminants. Thus, the present invention advantageously combines excellent glass seals, free of contaminants, and high pressure withstanding characteristics in an electrical connector or penetrator.

Hydrostatic pressure tests have been conducted on a 208 pin header mounted in a web support fixture simulating the present invention and on an identical but unsupported header as in the prior art connector. The header had a diameter of 4.5 inch and a width of 0.75 inch. The width of the web support for the header was 1.0 inch. The unsupported header was tested to 10,500 psi. The header was permanently deflected 0.060 inch. The glass seals had started to break up approximately ⅛ inch in depth on the pressure side of the header and the metal around the glass beads showed signs of pulling away from the glass on the low pressure side. Thus, the prior art header arrangement failed to pass the test at 10,500 psi. The supported header of the present invention was tested to 12,000 psi when the test fixture O-ring seals failed. An examination of the header showed no signs of deflection of the header or failure of the glass seals. Thus, the comparative tests establish that the connector of the present invention will withstand pressures greater than that which the prior connectors may withstand.

What is claimed is:

1. A high pressure withstanding electrical connector or penetrator comprising:

a shell adapted to be mounted in a bulkhead or the like;

said shell having an integral support web extending transversely across its interior dividing said shell into a high pressure side and a low pressure side;

a header mounted in said shell on said high pressure side, said header having an outer face and an inner face adjacent to said web;

said web providing support for said header across substantially its entire inner face;

aligned passages extending through said header and said web;

a conductor passing through said passages with one end extending into said high pressure side of said shell and the other end extending into said low pressure side; and a glass ring in said header passage providing a glass-to-metal seal between said conductor and said header, said glass ring extending substantially the complete length of said header passage.

2. A connector or penetrator as set forth in claim 1 including:

an insulation material other than glass in said web passage surrounding said conductor passing therethrough.

3. A connector or penetrator as set forth in claim 1 including:

means sealing the outer region of said header within said shell.

4. A connector or penetrator as set forth in claim 1 including:

an annular sealing member surrounding said header providing a seal between said header and said shell.

5. A connector or penetrator as set forth in claim 1 including:

means removably mounting said header in said shell.

6. A connector or penetrator as set forth in claim 1 including:

a recess in the outer face of said header;

said conductor passing through said recess; and a potting material filling said recess.

7. A high pressure withstanding electrical connector or penetrator comprising:

a shell adapted to be mounted in a bulkhead or the like;

said shell having an integral support web extending transversely across its interior dividing said shell into a high pressure side and a low pressure side;

a header removably mounted in said shell on said high pressure side, said header having an outer face and an inner face adjacent to said web;

said web providing support for said header across substantially its entire inner face;

a plurality of pairs of aligned passages extending through said header and said web;

a conductor passing through each pair of said passages with one end extending into said high pressure side of said shell and the other end extending into said low pressure side;

a glass ring in said header passage providing a glass-to-metal seal between said conductor and said header, said glass ring extending substantially the complete length of said header passage; and means sealing the outer region of said header within said shell.

8. A connector or penetrator as set forth in claim 7 including:

an insulation material other than glass in said web passages surrounding said conductors passing therethrough.

* * * * *

UNITED STATES PATENT OFFICE

CERTIFICATE OF CORRECTION

PATENT NO. : 4,445,744

DATED : May 1, 1984

INVENTOR(S) : Albert R. Sedig and Francis H. Ingham

It is certified that error appears in the above-identified patent and that said Letters Patent are hereby corrected as shown below:

Title page, Item [73] should read as follows:

--International Telephone and Telegraph Corporation--

Signed and Sealed this

*Thirteenth* Day of *November 1984*

[SEAL]

*Attest:*

GERALD J. MOSSINGHOFF

*Attesting Officer*

*Commissioner of Patents and Trademarks*